United States Patent [19]

Slade et al.

[11] 4,077,025

[45] Feb. 28, 1978

[54] CURRENT LIMITING CIRCUIT INTERRUPTER

[75] Inventors: Paul G. Slade, Churchill Borough; John A. Wafer, Monroeville, both of Pa.

[73] Assignee: Westinghouse Electric Corporation, Pittsburgh, Pa.

[21] Appl. No.: 725,080

[22] Filed: Sep. 21, 1976

Related U.S. Application Data

[63] Continuation of Ser. No. 577,518, May 15, 1975, abandoned.

[51] Int. Cl.[2] ..... H01H 75/10; H01H 77/02

[52] U.S. Cl. ..... 335/16; 335/195

[58] Field of Search ..... 335/16, 38, 170, 174, 335/195, 201

[56] References Cited

U.S. PATENT DOCUMENTS

| | | | |
|---|---|---|---|
| 3,263,042 | 7/1966 | Dyer et al. | 335/195 X |
| 3,663,905 | 5/1972 | Kussy et al. | 335/195 |
| 3,824,508 | 7/1974 | Terracol | 335/16 |
| 3,887,888 | 6/1975 | Bayles et al. | 335/195 |

*Primary Examiner*—George Harris
*Attorney, Agent, or Firm*—Robert E. Converse, Jr.

[57] ABSTRACT

A circuit interrupter having a fixed elongated contact arm, with a fixed contact disposed at the end thereof, and an elongated movable contact arm, with a movable contact disposed at the end thereof, and a magnetic driving device for rapidly separating the contacts. The magnetic driving device is formed of a ferromagnetic material and has a slot formed therein which is magnetically open on one end. The fixed contact arm is partially disposed in the slot near the closed end and the movable contact arm is partially disposed within the slot towards the open end. The magnetic drive or slot motor rapidly separates the contacts upon a predetermined overload. Divergent arc rails lying in the same general plane extend from the fixed contact and the movable contact. A magnetic arc gun or yoke having an opening therethrough disposed around the movable contact, the stationary contact and a portion of the arc rails when used concentrates the arc and provides for rapid arc movement by concentrating the magnetic forces generated by current flow which acts upon the arc.

26 Claims, 16 Drawing Figures

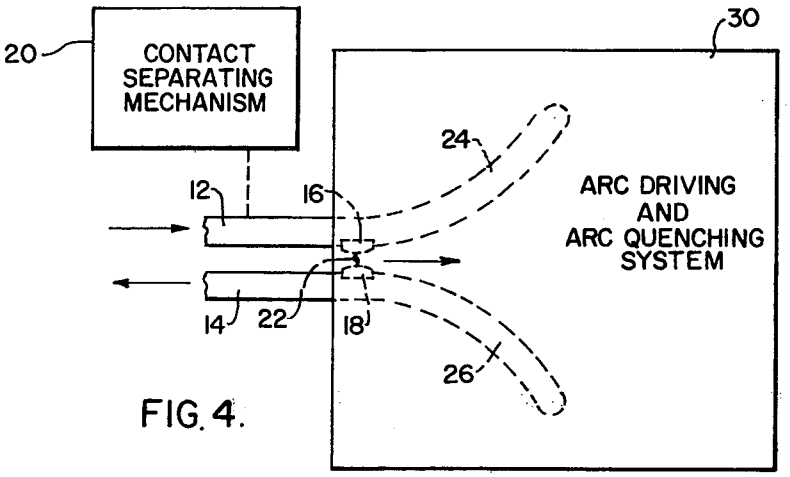
FIG. 4.
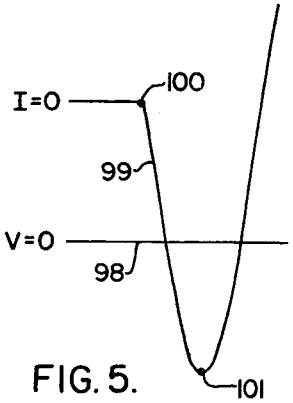
FIG. 5.
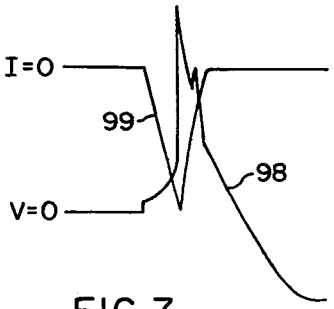
FIG. 6.
FIG. 7.
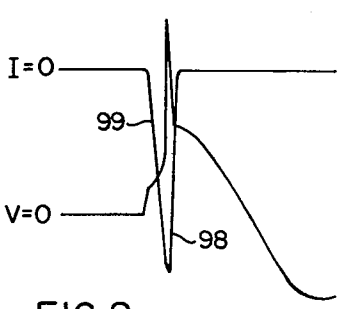
FIG. 8.

FIG.9.
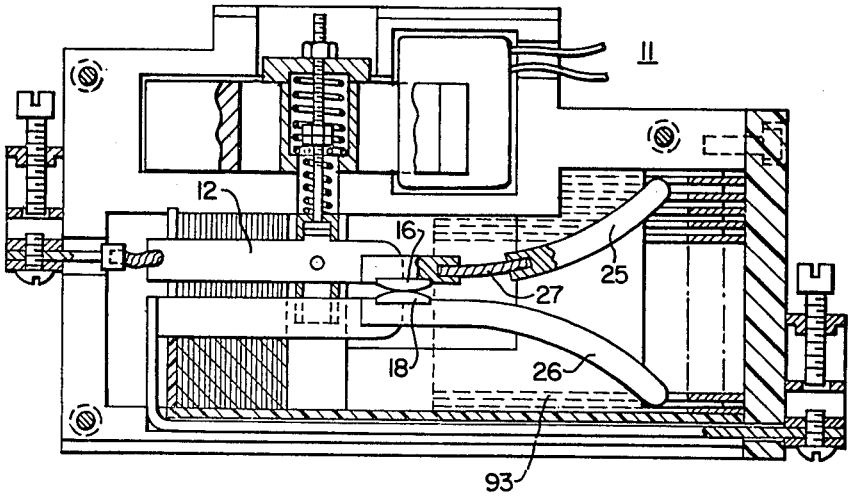
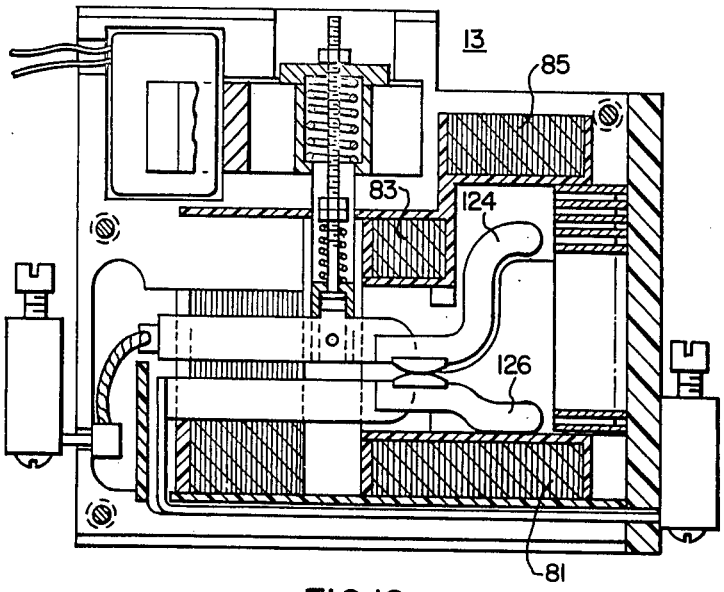
FIG.10.

CURRENT LIMITING CIRCUIT INTERRUPTER

This is a continuation of application Ser. No. 577,518 filed May 15, 1975, now abandoned

CROSS REFERENCE TO RELATED APPLICATIONS

The invention disclosed in the instant application is related to the following: (1) U.S. Pat. No. 3,978,300 to Paul G. Slade; (2) U.S. Pat. application Ser. No. 390,283, filed Aug. 21, 1973, now abandoned, by Paul G. Slade and John A. Wafer; (3) U.S. Pat. No. 4,042,895 to John A. Wafer and Paul G. Slade (4) U.S. Pat. No. 3,991,391 to John A. Wafer; and (5) U.S. Pat. application Ser. No. 602,625 filed Aug. 7, 1975 by Paul G. Slade and John A. Wafer.

BACKGROUND OF THE INVENTION

1. Field of the Invention

This invention is related to circuit interrupters and more particularly to current limiting circuit interrupters wherein a movable contact support arm and a stationary contact support arm are disposed within a slot formed in a magnetic contact arm driving device.

2. Description of the Prior Art

It is common in the prior art to provide for current limiting during circuit fault conditions. A common method of providing current limiting is through the use of current limiting fuses in combination with a standard stored energy type circuit interrupter as disclosed in U.S. Pat. No. 3,077,525 to Dyer. U.S. Pat. No. 3,815,059 to L. A. Spoelman discloses a circuit interrupter in series with an electromechanical current limiting device which utilizes a force generated by the overload current to drive the movable contact arm open. In U.S. Pat. No. 3,815,059 the current limiting interrupter was provided with a movable contact arm which was pivoted around one end and which moves into the slot of a magnetic drive device during circuit interruption.

When dealing with current limiting circuit interrupters the term $I^2t$ is often utilized to describe the effectiveness of a particular device. The meaning of $I^2t$ can best be understood by considering an electrical source feeding a simple resistive load through the circuit interrupter. The total energy seen by the load is given by: current (I) flowing through the load times the voltage drop (IR) across the load times the time ($t$) current flows. This can be expressed mathematically as energy dissipated equals $RI^2t$. During normal operation, this energy $RI^2t$ is easily dissipated by the system. When a fault current occurs, however, current (I) can become very large in value. For example, with present day power supplies possible fault current up to 100,000 amps on a 100 amp breaker can occur. During fault conditions the value of the load, R, will remain approximately the same but the total energy input into the system will be very large (R [fault current]$^2$ $t$). In a practical system, if the load is to be protected, the fault current should be limited to as small a value as possible. A reduction in the time of fault current flow, $t$, will give a further reduction in the energy input into the load. This means that in any current limiting device the total $I^2t$ i.e., (the integrated fault current)$^2$ $\times$ (time it flows) is the important parameter to measure. The smaller this $I^2t$ value the better the performance of the current limiting device.

In the circuit interrupter art, it has long been recognized that it is of a distinct advantage to provide fast interruption of an established arc. It is well known by those skilled in the art that it is desirable to affect a rapid extinction of the arc as quick as possible, inasmuch as the fault current flowing through connected electrical equipment will damage the equipment unless the fault current is limited. Due to heating, voltage surges, and the like it is desirable to affect extinction of the fault current arc as quick as possible.

It is also desirable to simplify the circuit interrupter structure to bring about cost reductions. Since circuit interrupter manufacturing is normally conducted on a high volume basis, cost and simplicity of the device is an important advantage. Likewise, the ability to rapidly reset and reuse the current limiting device is desirable, since resettable circuit interrupters have many well-recognized advantages over fused devices.

SUMMARY OF THE INVENTION

In accordance with the teachings of the present invention, a circuit interrupter is provided having a fixed contact mounted on a fixed contact arm, a movable contact mounted on a movable contact arm, and a magnetic drive means formed of a magnetizable material and having a slot formed therein within which are disposed a portion of the movable contact arm and the fixed contact arm so that upon a predetermined overload current flow through the associated contact arms, the movable contact arm is rapidly separated from the fixed contact arm providing effective fault current limiting. The magnetic drive means can be formed of laminated U-shaped sheets providing a slot, one end of which is magnetically open. The fixed conductor is mounted in proximity to the closed end of the slot and the movable contact arm is mounted for movement from a position wherein the circuit interrupter contacts are closed to a spaced-apart position in proximity to the open slot end. The magnetic drive means or slot motor is used in conjunction with a tripping mechanism which can be of the flux transfer variety, as for example, of the type illustrated in U.S. Pat. No. 3,544,932, or of a mechanical variety of a type, as for example, as is disclosed in U.S. Pat. No. 3,460,075. This tripping mechanism can open the circuit interrupter contacts when activated manually or by a remote single or in response to low overload conditions. During high overload conditions, the circuit breaker is opened rapidly by the concentrated magnetic forces provided by the slot motor. During heavy fault current conditions, the self-induced magnetic field generated within the magnetic drive structure causes strong opposing forces between the contact arms rapidly separating the contacts and thereby effecting a very rapid arc lengthening action. This rapid arc lengthening cause a rapid rise of the arc voltage across the arc plasma thereby bringing about desirable fault current limitation.

The disclosed current limiting circuit interrupter can be provided with divergent arc rails which are separated by only a short distance in proximity to the contacts to promote rapid lateral arc movement thereafalong. As the arc formed during circuit interruption moves along the diverging arc rail, it assumes a greater length requiring a higher arc voltage and providing current limiting. The arc rails can diverge at a uniform rate or a non-uniform rate. An arc extinguishing structure such as de-ion plates can be disposed in proximity to the divergent ends of the arc rails to facilitate arc extinction. The arc can be extinguished by elongating around the spaced-apart portions of the insulating plates, are of insulating material, or if the by causing the formation of a plurality of serially related arc portions between the spaced plates, if the plates are of conducting material.

A yoke formed of magnetizable material, such as laminated iron plates, can be disposed around the contacts and a portion of the arc rails, to concentrate the resultant magnetic field and provide for rapid outward movement of the arc. The magnetic forces effect a rapid outward lateral movement of the established arc during circuit interruption along the diverging arc rails and into contact with the arc extinguishing structure. The yoke can be of a uniform cross-sectional area or can vary to accommodate various arc rail configurations. The diverging arc rails can be rigidly attached to the contacts or connected to the contacts through flexible connectors.

It is an object of this invention to teach a circuit breaker having a pair of relatively movable contact support arms which are disposed within the magnetically open slots of a magnetic drive device which provides for rapid contact separation during large current overload.

It is a further object of this invention to disclose a circuit interrupter utilizing the combinations of a magnetic slot motor, a magnetic arc gun, and diverging arc rails for providing effective current limiting.

BRIEF DESCRIPTION OF THE DRAWINGS

For a better understanding of the invention, reference may be had to the preferred embodiment exemplary of the invention shown in the accompanying drawings, in which:

FIG. 4 is a diagrammatic view illustrating the principles involved in the present invention;

FIG. 5 is a graphic representation of an 18 kA bolted fault, current curve;

FIG. 6 is a graphic representation of the potential 18 kA fault with the circuit interrupter of the present invention utilized to provide current limiting;

FIG. 7 is similar to FIG. 6 but for a possible 30 kA fault;

FIG. 8 is similar to FIG. 6 but for a possible 100 kA current fault;

FIG. 9 is a side view of a current limiting circuit interrupter having fixed arcing rails;

FIG. 10 is a side sectional view of another embodiment of current limiting circuit interrupter utilizing the teaching of the present invention;

DESCRIPTION OF THE PREFERRED EMBODIMENTS

Figure 2:
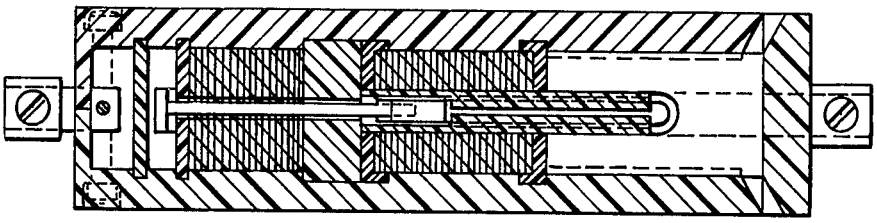
FIG. 2 is a top sectional view taken along the lines II—II of FIG. 1.

Referring now to the drawings and diagram FIG. 4 in particular, there is shown a diagrammatic representation of a circuit interrupter utilizing some of the teachings of the present invention. Circuit current passes through contact arms 12 and 14 into contacts 16 and 18 which engage when the circuit interrupter 10 is closed. During circuit interruption contact separating mechanism 20 moves contact arm 12 separating contacts 16 and 18 between which an arc 22 is formed. Arc rails 24 and 26 extending from contacts 16 and 18 respectively are provided. The arc 22 which is formed during circuit interruption moves rapidly to the right along diverging arc rails 24 and 26 increasing in length with a resulting increase in arc voltage. An arc driving and arc quenching system 30 is provided for enhancing the movement of arc 22 and for extinguishing the arc 22 as it reaches the extremities of arc rails 24 and 26. The current enters and leaves contact arms 12 and 14 as illustrated causing a magnetic field which forces the arc 22 to move in the direction indicated. The velocity of the arc 22 can be increased by utilizing suitable arc driving systems. When the arc reaches the end of the arcing rails it is foced into a suitable arc quenching system.

Figure 1:
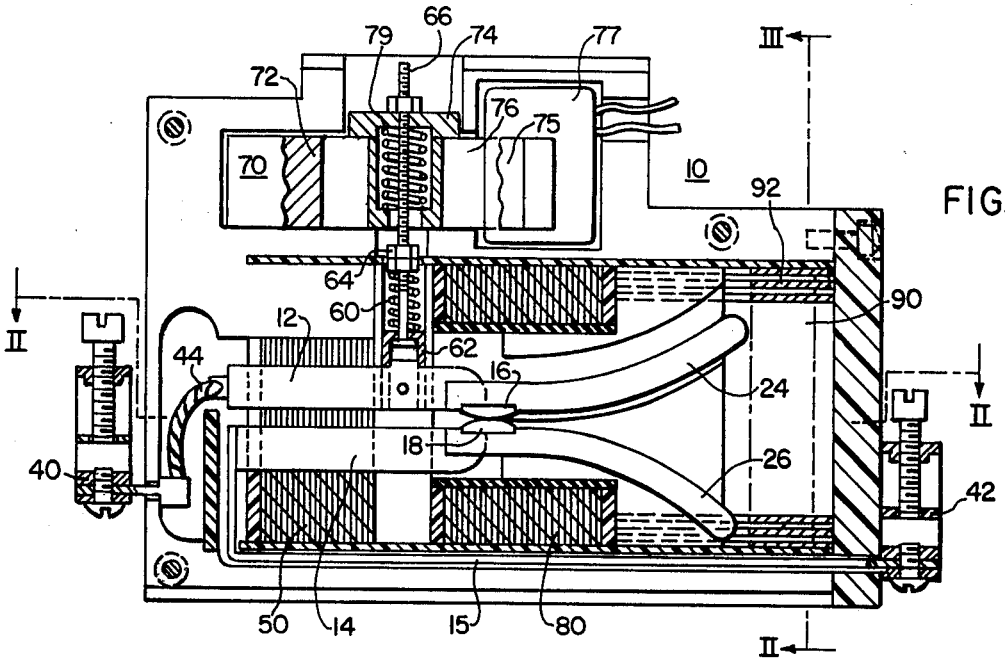
FIG. 1 is a vertical sectional view taken through a circuit interrupter embodying the teaching of the present invention.
Figure 11:
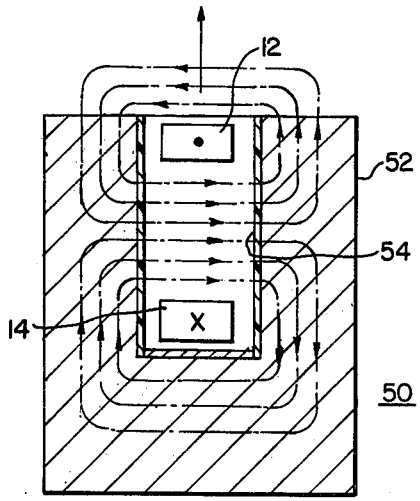
FIG. 11 is a diagrammatic view of a magnetic drive device as utilized in the disclosed current limiting circuit interrupter.
Figure 3:
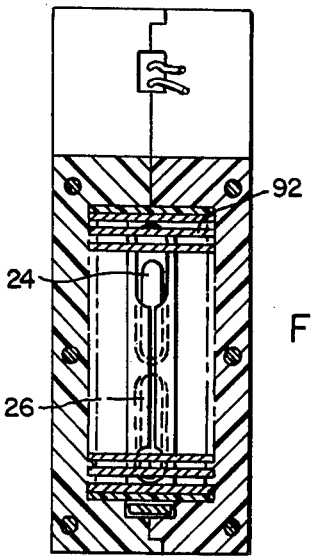
FIG. 3 is a side sectional view taken along the lines III—III of FIG. 1.

Referring now to FIGS. 1, 2 and 3 there is shown an operable circuit interrupter 10 which follows the general principles illustrated in FIG. 4. Line terminal 40 is provided for connection to a suitable power source. Load connector 42 is provided for connection to a load conductor. It is to be understood however that orientation of the circuit interrupter 10 can be interchanged without effecting operation as described hereinbelow. Current enters terminal 40, passes through flexible conductor 44 into movable contact arm 12. Movable contact arm 12 has contact 16 attached thereto. Contact arm 12 is movable between a closed position wherein contact 16 engages contact 18 and an open position wherein contact 16 is spaced apart from contact 18. Fixed contact 18 is supported by fixed contact arm 14. An electrical conductor 15 extends from the end of contact arm 14 opposite contact 18 to connector 42. Thus when circuit breaker 10 is in the closed position a continuous current path exists from connector 40 through flexible strap 44, contact arm 12, contact 16, contact 18, contact arm 14, conductor 15 to line connector 42. Current flow in contact arms 12 and 14 is in opposite directions. The magnetic force thus generated by current flow through elongated conductors 12 and 14 tends to force them apart. A magnetic drive or slot motor 50 is provided around a portion of contact arms 12 and 14 for concentrating magnetic flux generated by current flow through circuit interrupter 10 to rapidly open the contacts 16 and 18 when a predetermined overload current is exceeded. Referring now to FIG. 11, operation of the magnetic drive motor 50 can be better understood. Fixed conductor arm 14 is disposed towards the closed end of a slot 54 formed in member 52. Member 52 can be formed from a magnetizable material such as iron. Member 52 can be formed of a plurality of laminations held securely together or slightly separated. Magnetizable member 52 concentrates the magnetic flux generated by current flow through conductors 12 and 14. This force tends to urge conductors 12 and 14 apart. Conductors 12 and 14 are biased together and when the force between conductors 12 and 14 becomes sufficiently strong to overcome the bias they are rapidly separated opening contacts 16 and 18.

Figure 12:
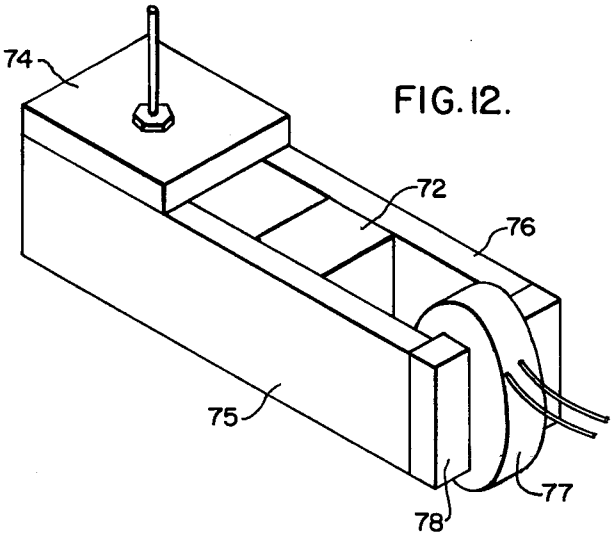
FIG. 12 is a perspective view of a flux transfer trip unit used in the disclosed current limiting interrupter.
Figure 13:
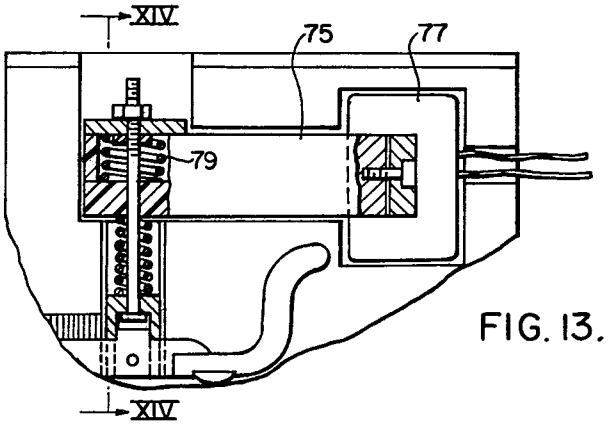
FIG. 13 is a side section view of the device shown in FIG. 12.
Figure 14:
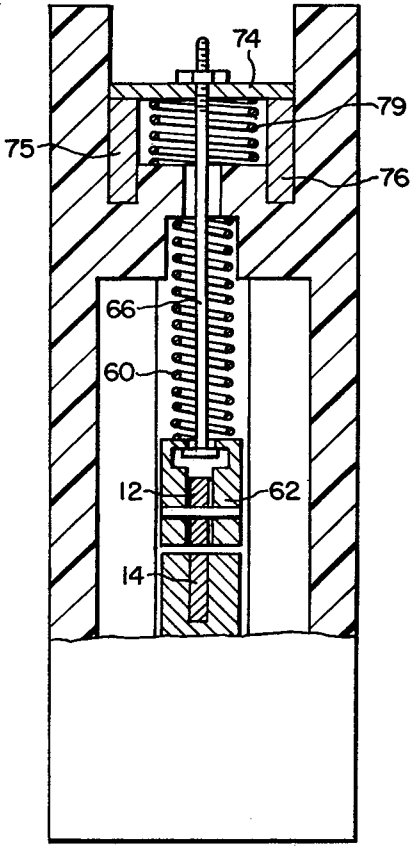
FIG. 14 is a view of the flux transfer trip unit of FIG. 13 along the lines XIV—XIV.

In the closed contact position of the circuit breaker 10 as illustrated in FIG. 1, the movable contact arm 12 is maintained in the closed circuit position by compression spring 60. Compression spring 60 is disposed between a bifurcated contact actuator 62 and adjustment nut 64. Adjusting nut 64 is threadably secured to a threaded portion of rod 66. A flux transfer device 70 of the type as illustrated more clearly in FIGS. 12–14 is utilized for maintaining the circuit breaker contacts 16 and 18 in the closed position. A permanent magnet 72 is utilized to maintain a movable magnetic keeper 74 in the closed position. Movable magnetic keeper 74 is movable between a closed position as illustrated in FIG. 1 and an open position wherein the circuit breaker contacts 16 and 18 are separated. Pole pieces 75 and 76 are disposed on opposite poles of permanent magnet 72. When keeper 74 is in the closed position a magnetic path is created from permanent magnet 72 through pole piece 75, keeper 74 and pole piece 76. Keeper 74 is thus held in contact with pole pieces 75 and 76 by a predetermined force which is dependent on the strength of permanent magnet 72. A trip coil 77 is provided around a fixed keeper 78. Fixed keeper 78 is attached to pole pieces 75 and 76 to provide a higher reluctance path than that provided through keeper 74. Thus with keeper 74 in contact with pole pieces 75 and 76 a majority of the magnetic flux will travel through keeper 74. When a trip coil 77 is energized with current of the proper polarity, the flux through keeper 74 will be bucked and the force holding keeper 74 in contact with pole pieces 75 and 76 will be relaxed. If keeper 74 is biased away from pole pieces 75 and 76 when the magnetic holding force is relaxed, keeper 74 will move to the unlatched position. Spring 79 biases keeper 74 to an unlatched position. Flux transfer trip coil 77 when energized effects a flux transfer in the magnetic system to release the magnetic forces imposed upon magnetic keeper 74 and permits the opening spring 79 to effect upward opening motion of movable contact arm 12 together with its movable contact 16. Member 62 is pinned to movable contact arm 12.

Upon the occurrence of a high fault current, magnetic drive system 50 will exert a very large upward force upon the movable contact arm 12 which, through shaft 66, will overcome the magnetic force holding keeper 74 in place. Keeper 74 will then be held in an unlatched position by opening spring 79. The magnetic drive system 50 rapidly moves contacts 16 and 18 to a spaced-apart relationship upon the occurrence of a predetermined overload. It will thus be noted that circuit interrupter 10 can be tripped open either by the action of contact arm 12 moving upward or by energizing flux transfer coil 77. Flux transfer coil 77 can be activated manually or can be connected to a current transformer and logic to open circuit breaker 10 upon the occurrence of various overload conditions in a time related manner. Upon the occurrence of fault currents above a predetermined magnitude, the magnetic drive or slot motor 50 will take over and cause the interrupter 10 to open rapidly. The upward motion will overcome the magnetic holding force upon keeper 74 and keeper 74 will then be held in the unlatched position.

A magnetic yoke or arc gun 80 as described more fully in copending application Ser. No. 602,625, filed Aug. 17, 1975 is provided around contacts 16 and 18 to rapidly force any arc formed during circuit interruption along arc rails 24 and 26. Thus any arc formed during circuit interruption is moved laterally not only by the self-induced magnetic field generated by current flow through contact arms 12 and 14 but additionally is moved faster by the concentrated magnetic field caused by yoke 80. Yoke 80 is formed from a plurality of soft iron lamination. As contacts 16 and 18 separate, the arc which is formed is forced rapidly along diverging arc rails 24 and 26 with increasing arc voltage thus providing current limiting. An arc extinguishing structure 90 comprising a plurality of space metallic plates 92 is disposed in proximity to the ends of arc rails 24 and 26. When the arc generated during circuit interruption enters the spaced metallic plates 92 it is divided into a plurality of serially related arc portions which become cooled by the surfaces of the metallic plates and are extinguished.

Referring now to FIG. 5 there is shown a graphic representation of an 18 kA bolted fault. In this trace the bolted fault current wave is shown. A shorting bus is used in place of the circuit breaker in the test circuit. A closing-in circuit breaker starts the current flow at point 100. This current rises to a peak value of approximately 37 kA at point 101. Curve 98 is a measure of the voltage across the bus. The resistance of the bus is so low that the voltage drop is very small. Curve 99 shows the fault current.

Referring now to FIG. 6 there is shown the same circuit hook-up as utilized for producing the fault in FIG. 5 but with the shorting bus removed and replaced by current limiting circuit interrupter 10. In this trace for the same circuit the current waveform 99 looks very different. This is due to the fact that the current limiting circuit breaker 10 now begins to limit current flow. The voltage drop across the circuit breaker 10 is shown by the voltage trace 98. This voltage raises to a peak value of about 980 volts which in this case limits the peak current to about 17.5 kA. This therefore limits the integrated $I^2$. The time, $t$, of current flow is also shortened. The current is interrupted after approximately 5 milliseconds instead of the 8 milliseconds for a complete half cycle fault current. Thus the let through $I^2t$ is dramatically reduced. Curves 7 and 8 illustrate the operation of circuit interrupter 10 for a possible 30 kA fault in FIG. 7 and a possible 100 kA in FIG. 8. These two curves are similar to the curves shown in FIG. 6 except they show the effect of higher possible fault currents. It can be seen that the device tends to work better the higher the possible fault current. It can be seen that no only does significant current limitation occur but also the duration of the current pulse was significantly decreased as the possible fault current increased. This means that although the peak current in the 100 kA test is higher than for both the 18 kA tests, the $I^2t$ value is not significantly larger.

Referring now to FIG. 9, there is shown a circuit breaker 11 illustrating another embodiment of the present invention. Operation of circuit breaker 11 is similar to that of circuit breaker 10 with the major difference being that the movable arcing rail 24 is replaced by a stationary arcing rail 25 which is connected to movable contact 16 by a flexible conductor 27. This construction fixes the spacing of arc rails 25 and 26 and decreases the mass to be moved by movable contact arm 12 during opening. Also in this embodiment of the invention magnetic arc gun 80 is deleted and the sides of the de-ion plates 93 extend to the contacts 16 and 18.

Referring now to FIG. 10, there is shown another embodiment of the disclosed current limiting circuit interrupter. Here circuit interrupter 13 is provided with arc rails 124 and 126 which have a substantially different shape than those for circuit interrupter 10. Circuit interrupter 13 also includes a magnetic arc gun 81 wherein the size of the opening is not uniform. Arc gun 81 is split into two parts 83 and 85 having a different cross-sectional area. Arc rails 124 and 126 relatively diverge much more rapidly in the center portion than near the end.

Figure 15:
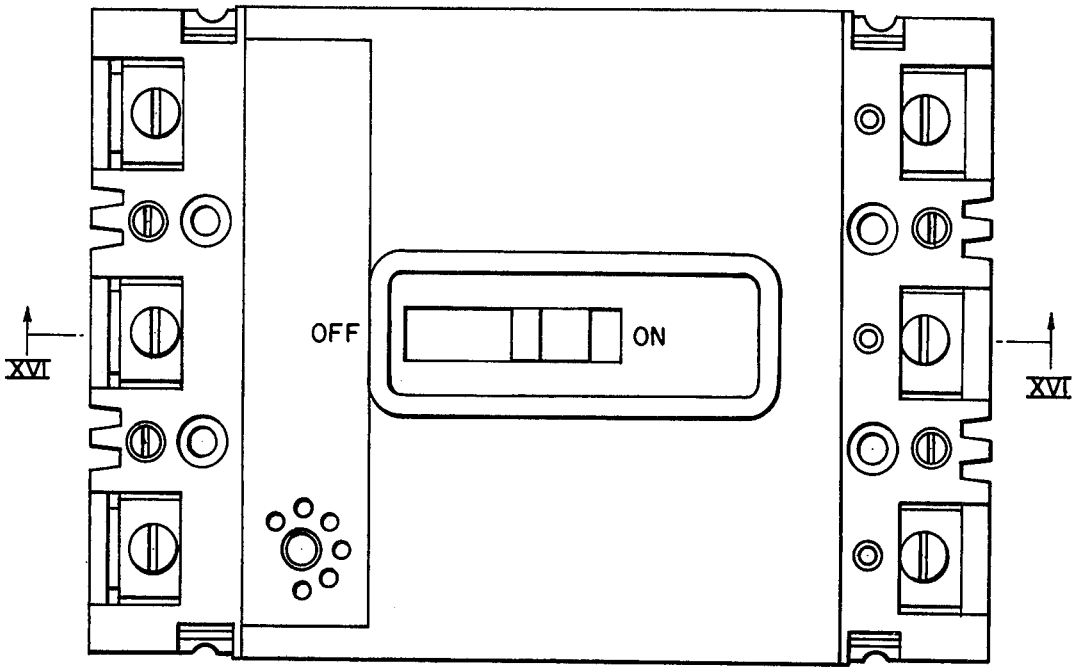
FIG. 15 is a top view of a current limiting circuit interrupter using a conventional over toggle trip unit; and, FIG. 16 is a side section view of the circuit interrupter of FIG. 15.
Figure 16:
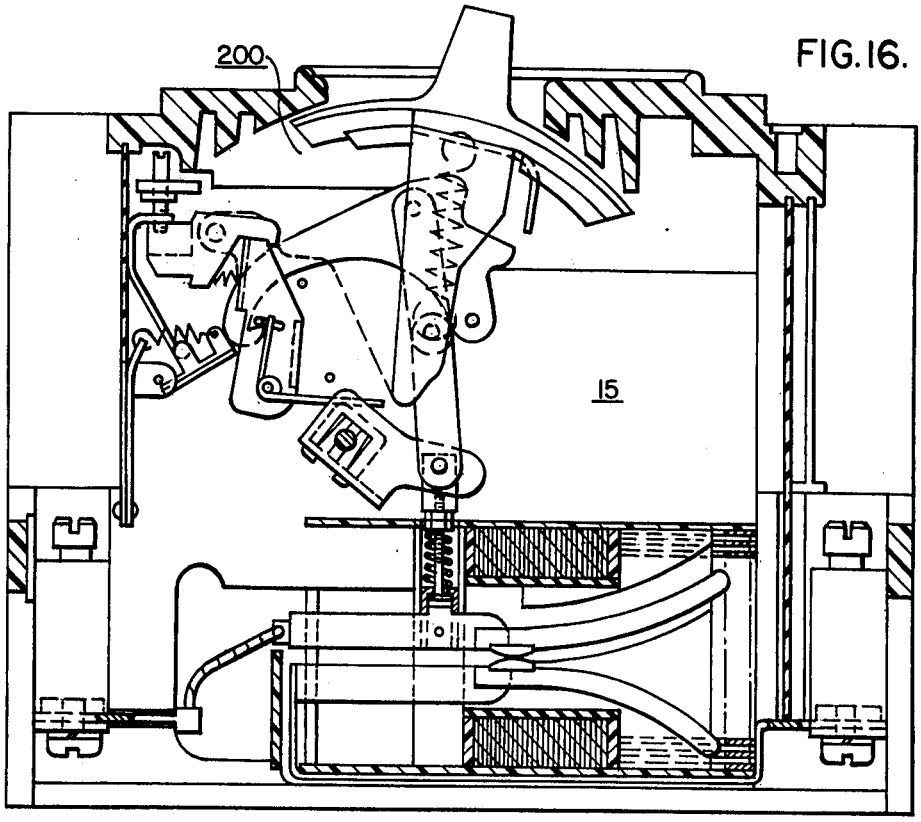

Another embodiment of the invention is shown in FIGS. 15 and 16 where an over-center toggle mechanism 200 is utilized for opening and latching circuit interrupter 15. Over-center toggle mechanisms 200 can be of any of the varities well known in the molded case circuit breaker art.

Note that for all circuit interrupters disclosed the contact separation when the circuit interrupter is open is relatively small. Preferably, the distance between the contacts 16 and 18, when in the open position, is quite small, say in the order of ¼ inch or less. This small separation has the desirable advantage that the self-induced magnetic field is thereby accentuated, causing rapid movement of the arc in a lateral direction along the associated arcing rails.

The disclosed circuit interrupter has several advantages such as: (1) a small contact gap in the open position requiring less movement allowing reduction in the size of the operating mechanism; (2) the arc is forced rapidly off of the contacts resulting in lower contact erosion; (3) lower contact erosion resulting in smaller less expensive contacts (4) lower contact erosion permitting the use of AgCdO contacts which drastically reduce heating resulting from contact resistance; (5) improved circuit interrupter current limiting and interrupting ability (6) the arc voltage generated during circuit interruption is higher than the line voltage permitting use in both AC and DC circuits; (7) relatively small and compact construction.

We claim:

1. A circuit interrupter comprising:

a housing;

a fixed contact disposed within said housing;

a fixed elongated contact arm supporting said fixed contact;

a movable contact disposed within said housing;

a movable elongated contact arm supporting said movable contact being movable between a closed position wherein said fixed contact and said movable contact are in engagement and an open position wherein said fixed contact and said movable contact are separated;

magnetic drive means comprising magnetizable material having a slot with one open end formed therein and being disposed around a portion of said fixed elongated contact arm and said movable elongated contact arm, with said fixed elongated contact arm being disposed toward the closed end of the slot and said movable elongated contact arm being disposed towards the open end of the slot; and means connected to said elongated contact arms for conducting circuit current therethrough, said circuit current flowing in opposite directions through said fixed elongated contact arm and said movable elongated contact arm.

2. A circuit interrupter as claimed in claim 1 including:

contact stop means for limiting movement of said movable contact to a relatively small separation from said stationary contact.

3. A circuit interrupter as claimed in claim 2 comprising:

a first arcing rail extending from said fixed contact;

a second arcing rail extending from said movable contact and diverging from said first arcing rail;

magnetic arc driving means formed of magnetizable material having an opening therethrough within which are disposed said fixed contact, said movable contact, said first arcing rail, and said second arcing rail.

4. A circuit interrupter as claimed in claim 3 comprising:

a plurality of U-shaped de-ion plates disposed around the free ends of said first arcing rail and said second arcing rail.

5. A circuit interrupter as claimed in claim 3 wherein:

said second arcing rail diverges from said first arcing rail more rapidly intermediate the ends thereof.

6. A circuit interrupter as claimed in claim 2 comprising:

a first fixed arcing rail extending from said fixed contact;

a second fixed arcing rail spaced apart and diverging from said first fixed arcing rail; and, flexible conducting means conducting said movable contact to said second fixed arcing rail.

7. A circuit interrupter as claimed in claim 1 comprising:

releasable latch means holding said fixed contact and said movable contact in engagement when the force tending to separate said fixed contact and said stationary contact is below a predetermined level.

8. A circuit interrupter as claimed in claim 7 wherein said releasable latch means comprises:

magnetic shunt trip means, having an electric trip coil, and being connected to said contact to trip when forces tending to separate said fixed contact and said stationary contact exceed a predetermined value and in the alternative to trip when said electric trip coil is energized.

9. A circuit interrupter comprising:

a fixed contact;

a movable contact;

a movable contact arm having said movable contact attached thereto and being movable between an open position wherein said movable contact is spaced apart from said fixed contact and a closed position wherein said movable contact engages said fixed contact;

biasing means biasing said movable contact arm to the closed position;

magnetic drive means comprising a magnetic material with a slot formed therein within which a portion of said movable contact arm is disposed for magnetically moving said movable contact arm to the open position when current flow through the circuit interrupter exceeds a predetermined overload value;

a first arcing rail extending from said fixed contact;

a second arcing rail electrically connected to and extending from said movable contact; and, a yoke formed of a magnetic material disposed around said fixed contact and said stationary contact.

10. A circuit interrupter as claimed in claim 9 wherein:

the slot formed in said magnetic drive means is open at one end; and comprising, a fixed contact arm having said fixed contact attached thereto and being relatively stationary; and, said fixed contact arm disposed toward the closed end of the slot in said magnetic drive means and said movable contact arm disposed toward the open end of the slot formed in said magnetic drive means.

11. A circuit interrupter as claimed in claim 10 comprising:

tripping means connected to said movable contact arm for moving said movable contact arm to the open position.

12. A circuit interrupter as claimed in claim 11 wherein said tripping means comprises:

a mechanical over-center toggle mechanism.

13. A circuit interrupter as claimed in claim 11 wherein said tripping means comprises:

a permanent magnet;

two pole pieces disposed on opposite poles of said permanent magnet;

a keeper formed of magnetizable material supported for movement between a tripped position spaced apart from said pole pieces and a latched position engaging said pole pieces and forming a magnetic flux path between said pole pieces;

connecting means connected between said keeper and said movable contact arm for holding said movable contact arm in the closed position until forces tending to move said movable contact arm exceed a predetermined level; and, latching means for latching said movable contact arm in the open position.

14. A circuit interrupter as claimed in claim 13 comprising:

a trip coil disposed around one of said pole pieces to buck the magnetic flux from said permanent magnet when energized.

15. A circuit interrupter as claimed in claim 9 wherein:

said magnetic drive means comprises a plurality of stacked laminations; and, said first arching rail and said second arcing rail lie in the same general plane and diverge as they extend from the point of contact between said fixed contact and said movable contact.

16. A circuit interrupter comprisig:

a fixed contact;

a movable contact;

a fixed contact arm having said fixed contact attached thereto;

a movable contact arm having said movable contact attached thereto and being movable between a closed position wherein said fixed contact is in engagement with said movable contact and an open position wherein said movable contact is spaced apart from said fixed contact;

first latching means connected to said movable contact arm for latching said movable contact arm in a closed position with a predetermined force;

magnetic drive means formed of a ferromagnetic material having a slot formed therein in which are disposed portions of said movable contact arm and said fixed contact arm; and means connected to said contact arms for conducting circuit current in one direction through said fixed contact arm and in the opposite direction through said movable contact arm.

17. A circuit interrupter as claimed in claim 16 wherein:

the slot formed in said magnetic drive means is open on one end and said fixed contact arm is disposed toward the closed end of the slot and said movable contact arm is disposed toward the open end of the slot.

18. A circuit interrupter as claimed in claim 17 wherein said first latch means comprises:

a permanent magnet;

a pair of pole pieces disposed on opposite poles of said permanent magnet;

a keeper movable between a latched position in engagement with said pair of pole pieces and forming a magnetic loop with said pair of pole pieces and said permanent magnet and an unlatched position spaced apart from said pair of pole pieces; and, connecting means mechanically connecting said keeper and said movable contact arm.

19. A circuit interrupter as claimed in claim 18 comprising:

a trip coil disposed around one of said pole pieces;

biasing means biasing said keeper toward the unlatched position; and, said trip coil disposed to buck the flux from said permanent magnet when energized to release said keeper permitting said keeper to move to the unlatched position and moving said movable contact arm to the open position.

20. A circuit interrupter as claimed in claim 16 comprising:

a yoke formed of magnetizable material having an opening therein within which are disposed said fixed contact and said stationary contact.

21. A circuit interrupter as claimed in claim 17 comprising:

a fixed arc rail extending from said fixed contact;

a movable arc rail extending from said movable contact and diverging from said fixed arc rail.

22. A circuit interrupter as claimed in claim 21 wherein:

said movable arc rail diverges at a faster rate intermediate the end thereof than at the end thereof.

23. A circuit interrupter as claimed in claim 20 wherein:

said yoke has an opening formed therethrough which is not of a uniform cross-sectional area.

24. A circuit interrupter comprising:

a housing;

separable contacts disposed within said housing and operable between open and closed positions;

a pair of elongated contact arms supporting said separable contacts, magnetic drive means comprising magnetizable material having a slot with one open end and one closed end formed therein, said magnetic drive means being disposed around a portion of said elongated contact arms; and means connected to said elongated contact arms for conducting circuit current therethrough, said circuit current flowing in opposite directions through said elongated contact arms.

25. A circuit interrupter as recited in claim 24 wherein said conducting means comprises an electrical conductor disposed outside of said slot and adjacent the closed end of said slot, said conductor being connected to one end of the one of said elongated contact arms closest to the closed end of said slot, whereby said conductor and said one of said elongated contact arms form a loop around the closed end of said slot.

26. A circuit interrupter comprising:

a housing;

separable contacts disposed within said housing and operable between open and closed positions;

a pair of elongated contact arms supporting said separable contacts;

magnetic drive means comprising magnetizable material and having a slot with one open end and one closed end formed therein, said magnetic drive means being disposed around a portion of said elongated contact arms; and means connected to the one of said elongated contact arms closest to the closed end of said slot for conducting circuit current through the one of said elongated contact arms, said conducting means being disposed outside of said slot and adjacent the closed end of said slot and combining with the one of said elongated contact arms to form a loop around the closed end of said slot.

* * * * *